US010014139B2

(12) United States Patent
Cary et al.

(10) Patent No.: US 10,014,139 B2
(45) Date of Patent: Jul. 3, 2018

(54) OVER-CURRENT PROTECTION ASSEMBLY

(71) Applicant: General Electric Company, Schenectady, NY (US)

(72) Inventors: Stephen Michael Cary, Mebane, NC (US); Ivan Funcic, Mebane, NC (US); Amit Narang, Mebane, NC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 0 days.

(21) Appl. No.: 14/842,958

(22) Filed: Sep. 2, 2015

(65) Prior Publication Data

US 2017/0062155 A1 Mar. 2, 2017

(51) Int. Cl.

| | |
|---|---|
| ***H01H 33/04*** | (2006.01) |
| ***H01H 33/42*** | (2006.01) |
| ***H01H 11/00*** | (2006.01) |

(52) U.S. Cl.

CPC ..... *H01H 33/04* (2013.01); *H01H 11/00* (2013.01); *H01H 33/42* (2013.01); *H01H 2205/002* (2013.01)

(58) Field of Classification Search

CPC ..... H01H 33/04; H01H 33/42; H01H 33/14; H01H 33/6644–33/6647; H01H 33/6662; H01H 11/00; H01H 2205/002

USPC ..... 218/143, 126, 123, 118, 3; 200/16 R, 200/19.07, 19.18, 50.34, 148 R, 148 H

See application file for complete search history.

(56) References Cited

U.S. PATENT DOCUMENTS

| | | | | |
|---|---|---|---|---|
| 2,676,285 | A | 4/1954 | Jansson et al. | |
| 3,214,548 | A | 10/1965 | Schrameck et al. | |
| 3,421,128 | A | 1/1969 | Klein | |
| 3,814,882 | A | 6/1974 | Harrold | |
| 4,087,664 | A * | 5/1978 | Weston | H01H 33/143 218/3 |
| 4,458,119 | A * | 7/1984 | Hashimoto | H01H 33/143 218/3 |
| 4,507,527 | A | 3/1985 | Pardini | |
| 4,620,124 | A | 10/1986 | Farrall et al. | |
| 4,910,485 | A | 3/1990 | Bolongeat-Mobleu et al. | |
| 5,153,399 | A * | 10/1992 | Schaffer | H01H 33/022 200/11 TC |
| 6,593,538 | B2 * | 7/2003 | Perret | H01H 33/143 218/3 |
| 7,718,913 | B2 * | 5/2010 | Frigiere | H01H 33/6661 218/2 |
| 2004/0074875 | A1 * | 4/2004 | Munakata | H01H 33/002 218/118 |

(Continued)

FOREIGN PATENT DOCUMENTS

WO 2012063251 A1 5/2012

*Primary Examiner* — Renee Luebke
*Assistant Examiner* — William Bolton
(74) *Attorney, Agent, or Firm* — GE Global Patent Operation; Stephen G. Midgley

(57) ABSTRACT

Embodiments are directed to an over-current protection assembly that includes a mechanism having a first operating element and a second operating element. The first operating element is coupled to a first set of individual contacts. The second operating element is coupled to a second set of individual contacts. A single movement of the first operating element relative to the second operating element breaks a plurality of electrical contacts or paths between the first set of individual contacts and the second set of individual contacts.

23 Claims, 15 Drawing Sheets

(56) References Cited

U.S. PATENT DOCUMENTS

| | | | | |
|---|---|---|---|---|
| 2005/0150869 | A1* | 7/2005 | Vaghini ..... | H01H 33/6661 218/118 |
| 2013/0048484 | A1 | 2/2013 | Bausch et al. | |

* cited by examiner

OVER-CURRENT PROTECTION ASSEMBLY

BACKGROUND OF THE DISCLOSURE

The subject matter disclosed herein relates to over-current protection for power circuits. More specifically, the subject matter disclosed herein relates to a simple and efficient over-current protection assembly that enables the use of multiple contacts in parallel & series to disconnect high voltages and/or currents resulting in improved breaking performance.

Over-current protection devices provide electrical protection and/or isolation to electrical systems. Examples of over-current protection/isolation devices include but are not limited to circuit breakers, interrupters, switches, contactors and the like. Although there are slight differences in the operation and/or application of these devices, they perform substantially the same basic function of protecting and/or isolating an electrical system whenever an electrical abnormality or normal load switching occurs in any part of the system. The above-described terms are used interchangeably in the present disclosure to refer broadly to over-current protection devices and/or assemblies. Accordingly, it is intended that any part of this disclosure that makes specific reference to one type of over-current protection device and/or assembly applies equally to other types.

Circuit breakers are a well-known over-current protection device. Circuit breakers come in a wide variety of sizes and configurations, based primarily on the characteristics and needs of the electrical system that the circuit breaker is designed to protect. One example of a known circuit breaker configuration is a rotary contact circuit breaker. In a rotary contact circuit breaker, current enters the electrical system from a power line. The current passes through a load strap to a stationary main contact fixed on the strap, and then to a moveable main contact. The moveable main contact is fixedly attached to an arm, and the arm is mounted to a rotor that is rotatably mounted in a cassette.

As long as current passing through the load strap is below a predetermined level, the fixed contact remains in physical contact with the moveable main contact, and the current passes from the fixed main contact to the moveable main contact and out of the circuit breaker to down line components of the electrical system. However, if an extremely high over-current condition occurs (e.g., a short circuit), electromagnetic forces are generated between the fixed and moveable main contact pair. These electromagnetic forces repel the movable main contact away from the fixed main contact. Because the moveable main contact is fixedly attached to a rotating arm, the arm pivots and physically separates the fixed main contact from the moveable main contact, thus tripping the unit, breaking the flow of current and isolating down line components.

An arc is generated when contacts separate and the current path is interrupted. Different circuit breakers use vacuum, air, insulating gas or oil inside the circuit breaker chamber to contain, cool and extinguish arcs in a controlled way. This allows the gap between contact pairs to again withstand the voltage in the circuit. In addition to the above-described main contact pairs, known circuit breaker configurations also provide arc contact pairs that assist in controlling arcs by providing a path for arc currents to be absorbed when the main contact pair is opened. In some circuit breaker configurations, the main contact pair handles both main and arc currents.

It has been proposed to provide over-current protection devices having multiple main and/or arcing contacts. In such devices, each fixed/movable contact pair requires its own separate and relatively complex mechanism for opening and closing the contacts. The need for a separate opening/closing mechanism for each contact pair generally increases the cost, device footprint and operational inefficiency of known multi-contact over-current protection devices. In some cases, the variance in opening times and geometry of the extra linkages requires additional electrical parts to equalize arc voltages across the contacts that are arranged in series.

BRIEF DESCRIPTION OF THE DISCLOSURE

Embodiments are directed to an over-current protection assembly that includes a mechanism having a first operating element and a second operating element. The first operating element is coupled to a first set of individual contacts. The second operating element is coupled to a second set of individual contacts. A movement of the first operating element relative to the second operating element breaks a plurality of electrical paths between the first set of individual contacts and the second set of individual contacts. During this single movement, the current from the main contacts commutates to the breaking contacts. Likewise, during closing the arcing contacts close first establishing current which is then commutated to the low resistance connection of the main contact current path.

In one or more embodiments of the above-described assembly, the first and second sets of individual contacts are arranged in a voltage divider configuration, wherein the voltage divider divides among the individual contacts a total voltage that is present across the first and second sets of individual contacts.

Embodiments are further directed to a method of operating an over-current protection assembly. The method includes initiating a movement of a first operating element of a mechanism relative to a second operating element of the mechanism, wherein the first operating element is coupled to a first set of individual contacts, and the second operating element is coupled to a second set of individual contacts. The method further includes breaking, by the single movement, a plurality of electrical paths between the first set of individual contacts and the second set of individual contacts.

In one or more embodiments of the above-described method, the first and second sets of individual contacts are arranged in a voltage divider configuration, wherein the method further includes dividing, by the voltage divider, among the individual contacts a total voltage that is present across the first and second sets of individual contacts.

Embodiments are further directed to a method of making an over-current protection assembly. The method includes providing a mechanism having a first operating element and a second operating element. The method further includes coupling the first operating element to at least one first set of individual contacts. The method further includes coupling the second operating element to a second set of individual contacts. The method further includes configuring an actuator system to initiate a movement of the first operating element relative to the second operating element, wherein the movement of the first operating element relative to the second operating element breaks a plurality of electrical paths between the first set of individual contacts and the second set of individual contacts.

In one or more embodiments of the above-described method of making an over-current protection assembly, the first and second sets of individual contacts are arranged in a voltage divider. The voltage divider is configured to divide among the individual contacts a total voltage that is present across the first and second sets of individual contacts.

These and other advantages and features will become more apparent from the following description taken in conjunction with the drawings.

BRIEF DESCRIPTION OF THE DRAWINGS

The subject matter of the present disclosure is particularly pointed out and distinctly claimed in the claims at the conclusion of the specification. The foregoing and other features, and advantages of the present disclosure are apparent from the following detailed description taken in conjunction with the accompanying drawings in which:

Figure 1:
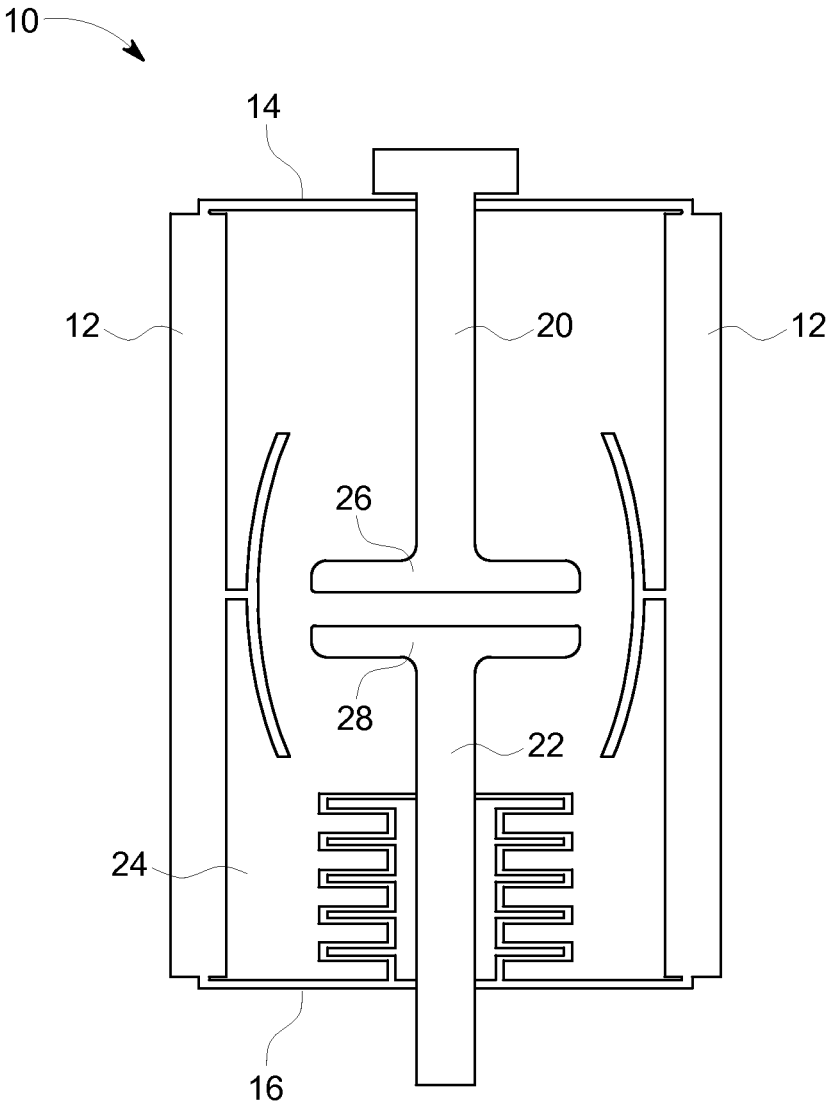
FIG. 1 PRIOR ART
FIG. 1 depicts a schematic diagram illustrating a known vacuum interrupter assembly having movable bellows and insulation components.

In the accompanying figures and following detailed description of the disclosed embodiments, the various elements illustrated in the figures are provided with reference numbers. The leftmost digit(s) of each reference number corresponds to the figure in which its element is first illustrated.

DETAILED DESCRIPTION OF THE DISCLOSURE

Various embodiments of the present disclosure will now be described with reference to the related drawings. Alternate embodiments may be devised without departing from the scope of this disclosure. It is noted that various connections are set forth between elements in the following description and in the drawings. These connections, unless specified otherwise, may be direct or indirect, and the present disclosure is not intended to be limiting in this respect. Accordingly, a coupling of entities may refer to either a direct or an indirect connection.

It is to be understood in advance that although this disclosure includes a detailed description of vacuum interrupters, implementation of the teachings recited herein are not limited to a particular type of over-current protection pressurized gas or open air assembly. Rather, embodiments of the present disclosure are capable of being implemented in conjunction with any type of over-current protection assembly now known or later developed.

As previously noted herein, the basic function of an over-current protection assembly such as a circuit breaker is to protect and/or isolate the electrical system whenever an electrical abnormality occurs in any part of the system. One example of a known circuit breaker configuration is a rotary contact circuit breaker. In a known rotary contact circuit breaker configuration, current enters the electrical system from a power line. The current passes through a load strap to a stationary contact fixed on the strap, and then to a moveable contact. The moveable contact is fixedly attached to an arm, and the arm is mounted to a rotor that is rotatably mounted in a cassette.

As long as current passing through the load strap is below a predetermined level, the fixed contact remains in physical contact with the moveable main contact, and the current passes from the fixed main contact to the moveable main contact and out of the circuit breaker to down line components of the electrical system. However, if an over-current condition (exceeding designed load parameters) occurs (e.g., a short circuit), electromagnetic forces are generated between the fixed and moveable main contact pair. These electromagnetic forces repel the movable main contact away from the fixed main contact. Because the moveable main contact is fixedly attached to a rotating arm, the arm pivots and physically separates the movable main contact from the fixed main contact, thus tripping the unit, breaking the flow of current and isolating down line components.

Circuit breakers are made in varying sizes, from small devices, which protect an individual household appliance, up to large switchgear designed to protect high voltage circuits feeding an entire city. The circuit breaker contact pair must carry the load current without excessive heating, and must also withstand the heat of the arc produced when interrupting (opening) the contacts. Individual contacts are made of copper or copper alloys, silver alloys and other highly conductive materials. The service life of an individual contact is limited by the erosion of contact material due to arcing while interrupting the current. Miniature and molded-case circuit breakers are usually discarded when the contacts have worn, but power circuit breakers and high-voltage circuit breakers have replaceable contacts or interrupters.

As previously noted herein, an arc is generated when the contacts separate. This arc must be contained, cooled and extinguished in a controlled way, such that the gap between the contact pairs can again withstand the voltage in the circuit. Different circuit breakers use vacuum, air, insulating gas or oil as the medium in which the arc forms. In higher voltage configurations, oil circuit breakers rely upon vaporization of some of the oil to blast a jet of oil through the arc. Gas (usually sulfur hexafluoride ($SF_6$)) circuit breakers sometimes stretch the arc using a magnetic field, and then rely on the dielectric strength of $SF_6$ to quench the stretched arc. Air circuit breakers may use compressed air to blow out the arc, or alternatively, the contacts are rapidly swung into a small sealed chamber in which the escaping displaced air blows out the arc. Vacuum circuit breakers have minimal arcing compared to other technologies (as there is nothing to ionize other than the contact material that has vaporized), so the arc quenches when it is stretched a very small amount (less than 2-3 millimeters or 0.079-0.118 inches). Vacuum circuit breakers are frequently used in modern medium-voltage switchgear up to 38,000 volts. Conventional circuit breakers are usually able to extinguish arcs between 30 and 150 milliseconds after the mechanism has been tripped, depending on age and construction of the device.

Turning now to an overview of the present disclosure, the subject matter disclosed herein provides a simple and efficient multi-contact, over-current protection assembly that eliminates the need for complex mechanisms to open and close each contact pair. The multiple contact pairs may include a set of arc contact pairs dedicated to absorbing arc currents, along with a set of main contact pairs dedicated to absorbing the main current of the system. Alternatively, the multiple contact pairs may include a set of contact pairs that absorb both main and arc currents. In one or more embodiments, the multiple contact pairs are opened substantially in unison by a single operating element moving through a relatively short distance (e.g., approximately ¼ of a turn or less of a cylindrical implementation of the single operating element). For embodiments in which the main and arc contacts are separate, the contacts are arranged such that all the main contacts open immediately before the arc contacts open. The current commutates from the main contacts to the arc contacts. The single operating element may be implemented as a cylindrically shaped rotor, and the multiple contact pairs may be arranged along a surface of the rotor. The cylindrically shaped rotor may be implemented in a unitary construction or it may be implemented in multiple sections coupled together such that the multiple sections move in unison. The opening/closing action of the rotor is a rotational movement, which, depending on design choices, may be as small as approximately ¼ of a complete turn or less. An actuator system moves the rotor, and may be provided either within or external to the over-current protection assembly enclosure. In either actuator configuration, the actuator system may move the rotor magnetically (e.g., coils and permanent magnets), thereby eliminating the need to provide physical coupling between the actuator system and the rotor. Depending on the configuration, hydraulics, pneumatics, springs, magnetic energy or a combination of mechanisms can be used to close and open the contacts.

Continuing with an overview of the present disclosure, the contact pairs may be arranged such that at least some of the contact pairs form a voltage divider. The voltage divider is configured to divide among the individual contacts the total voltage that is present across all of the individual contacts. This voltage division allows the over-current protection assembly to withstand high voltages immediately after current zero, which lowers the transient recovery voltage stress across the gap between individual contacts, thereby allowing the interruption of higher voltages in a compact enclosure. If the over-current protection assembly enclosure includes a gas such as $SF_6$, and if the actuator system is implemented using magnetic coupling to rotate the cylinder, the enclosure can tolerate higher pressure because there no need to account for gas leaks by providing gas seals at the interface to the actuator system. If the over-current protection assembly enclosure is a vacuum, according to Paschen's law, the dielectric capabilities a contact pair will increase with decreasing distances between the individual contacts. Vacuum-enclosed contact pairs, however, release metal vapors between the individual contacts, which can act to sustain the arc and delay current interruption. The disclosed voltage divider contact configuration naturally solves the technical problems of individual contacts welding by having a smaller voltage across each contact pair, thereby allowing the use of an even smaller operating element. The transient recovery voltage across individual contacts is also reduced in proportion by increasing the number of contact pairs in the voltage divider. With enough contact pairs in the voltage divider, the over-current protection assembly can advance a current zero and sustain minimal arcing. Because the disclosed over-current protection device collapses the current quickly, it also speeds up the time to interrupt. Individual contacts of the disclosed main and arcing contact pairs may be arranged in "opposing" configurations along a surface of the operating element such that a first set of main contact pairs is offset by approximately 180 degrees from a second set of main contact pairs in a two-dimensional plane that cuts through the operating element, and such that a first set of arc contact pairs is offset by approximately 180 degrees from a second set of arc contact pairs in the same two-dimensional plane. Accordingly, a rotation of the operating element rotor shaft that opens the first and second main contact pairs separates the first set of main contact pairs in one direction in the two-dimensional plane and separates the second set of main contact pairs in another direction in the two-dimensional plane. Similarly, a rotation of the operating element rotor shaft that opens the first and second arc contact pairs separates the first set of arc contact pairs in one direction in the two-dimensional plane and separates the second set of arc contact pairs in another direction in the two-dimensional plane. This "opposing" configuration of the main and arc contact pairs naturally balances the short-time forces at the center of the operating element rotor shaft. Accordingly, the reduced welding, low transient recovery voltages, advancing current zeros and low short-time forces make the disclosed over-current protection assembly design suitable for higher voltages and for use on low energy operators.

FIG. 1 is a schematic diagram illustrating a known configuration of an over-current protection device in the form of a vacuum interrupter 10 having metal end-plates 14, 16, an insulating component 12, bellows 24, a fixed electrode 20, a moveable electrode 22 and individual contacts 26, 28, configured and arranged as shown. A linearly actuated mechanism (not shown) attaches to moveable electrode 22 which travels in along a linear direction. Vacuum interrupter 10 uses contact pairs (e.g., individual contacts 26, 28) of various complex shapes made of copper chromium (typically a 40% to 60% mixture) and other metal alloys. Because the same contacts conduct continuous currents and interrupt the short circuit, vacuum interrupter 10 is not optimized for either duty. The high voltages across the contacts that weld the contacts, along with unbalanced short-time forces, increase the cost, device footprint and operational inefficiency of the configuration shown in FIG. 1. Additional parts such as metal vapor contact shields are often mounted to collect vapor created from the weld or metal bridge that explodes on contact separation.

Figure 2:
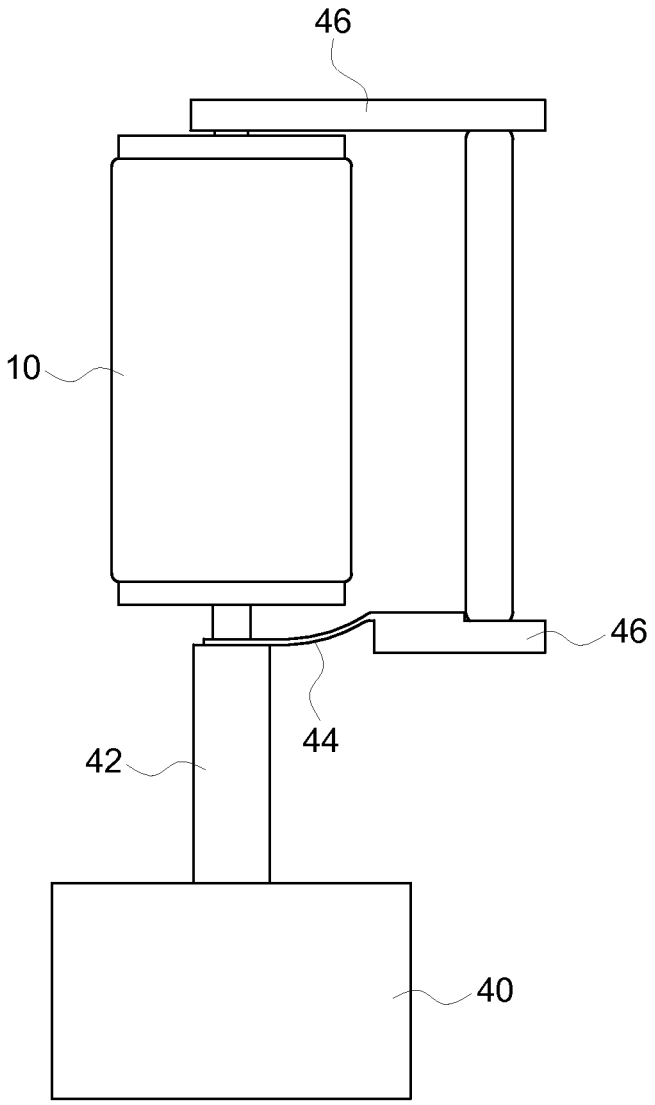
FIG. 2 PRIOR ART
FIG. 2 depicts a schematic diagram illustrating a known vacuum interrupter assembly having an external actuator, flexible connections and an insulation rod.

FIG. 2 is a schematic diagram illustrating another known configuration of an over-current protection device in the form of a vacuum interrupter 10A having bus bars 46, a flexible connection 44, an insulation rod 42, and an actuator 40, configured and arranged as shown. Actuator 40, insulation rod 42 and flexible connection 44 are external to vacuum interrupter 10A. The use of a large external actuator 40, insulation rod 42 and flexible connection 44 increases the cost, device footprint and operational inefficiency of the configuration shown in FIG. 2.

Other known, relatively costly and complex actuator mechanisms include but are not limited to tension spring operators and clock spring operators. The typical time it takes for a "fast" operating spring actuated circuit breaker to reach design contact distances and interrupt is three cycles of alternating current. In some cases, the device designer intentionally delays the opening of the interrupter to save cost on the vacuum interrupter design by allowing the direct current component to decay before opening. The entire system consists of complex linkages, motors, shunt trips, latches, two or more springs, cams, shafts, dampers, gears or pawl assemblies, insulating rods, and manual charging mechanisms, which all limit the speed at which the contact pair the contact is opened. Spring operated mechanisms typically open between 20 and 60 milliseconds. Because current zeroes are spaced 120 degrees from each other, the arcing time for the last pole to clear is further extended.

Interrupt actuator systems may also be implemented as electromagnets, which can typically interrupt after one cycle of alternating current. Known circuit breaker configurations that incorporate electromagnetic interrupt actuators include individual contacts that butt together. Thus, the electromagnetic actuator is subject to 100% of the circuit breaker short circuit momentary close and latch forces. For this reason, the short circuit current limits of electromagnetically actuated circuit breakers have limited the implementation of electromagnetic actuating mechanisms relative to spring operated actuating mechanisms.

Figure 3:
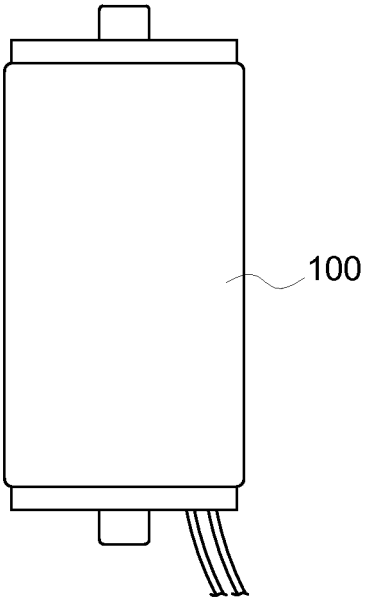
FIG. 3 depicts a high level schematic diagram illustrating an external view of a vacuum interrupter assembly and actuator system according to one or more embodiments.

FIG. 3 is a high-level schematic diagram illustrating an external view of an over-current protection assembly having an actuator system according to one or more embodiments. The over-current protection assembly shown in FIG. 3 is described in connection with a vacuum interrupter configuration. However, as previously noted herein, the teachings of a particular over-current protection embodiment apply equally to any type of over-current protection configuration now known or later developed. As shown in FIG. 3, the illustrated over-current protection system is in the form of a vacuum interrupter 100. Because vacuum interrupter 100 and its internal actuator system (not shown) are self-contained, current carrying bus bars (not shown) may connected directly to vacuum interrupter 100. In one or more embodiments, the actuator system may also be provided external to vacuum interrupter 100. As described and illustrated in more detail below, the simple and efficient configuration of vacuum interrupter 100 avoids the increased cost, device footprint and operational inefficiency of known over-current protection device designs.

Figure 4:
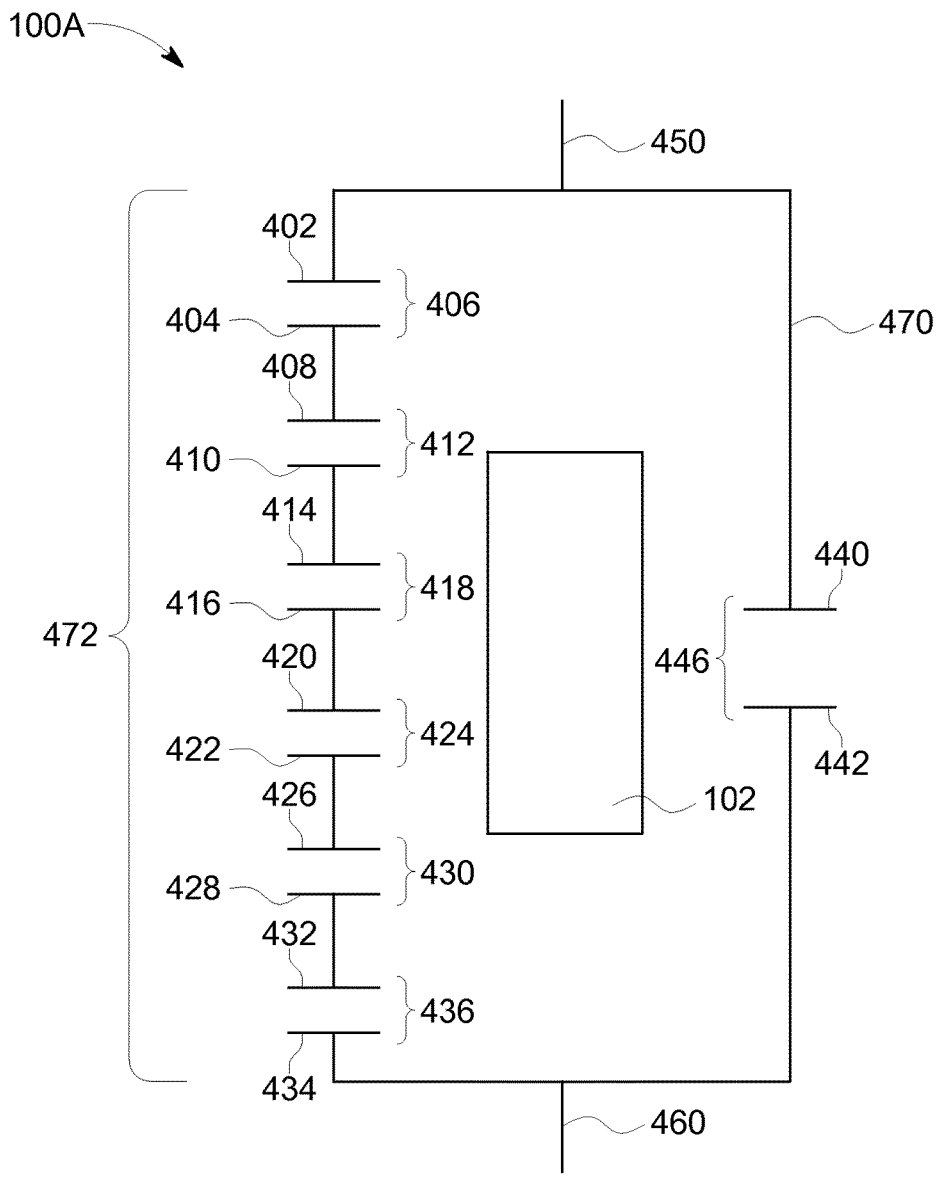
FIG. 4 depicts a schematic diagram illustrating additional details of the vacuum interrupter assembly shown in FIG. 3.

FIG. 4 is a schematic electrical diagram of a rotary vacuum interrupter 100A that illustrates additional details of vacuum interrupter 100 shown in FIG. 3. As shown, rotary vacuum interrupter assembly 100A includes a vacuum enclosure 470, end terminals 450, 460, an actuator system 102, a main contact pair 446 formed from individual main contacts 440, 442, and a set of arc contact pairs 406, 412, 418, 424, 430, 436 each formed from individual arc contacts 402, 404, 408, 410, 414, 416, 420, 422, 426, 428, 432, 434, configured and arranged as shown. The schematic electrical diagram shown in FIG. 1 illustrates the parallel electrical relationship between main contact pair 446 and arc contact pairs 406, 412, 418, 424, 430, 436, which means that current can flow through the vacuum interrupter assembly 100A through either main contact pair 446 (when closed) or arc contact pairs 406, 412, 418, 424, 430, 436 (when all are closed). When all contacts are closed, current flows through main contact pair 446 because its current path has a lower resistance than the current path provided by arc contact pairs 406, 412, 418, 424, 430, 436. The schematic electrical diagram shown in FIG. 1 does not, however, illustrate the previously described opposing contact configurations that balance the electromagnetic short time forces at the center of the operating element rotor shaft 604 (shown in FIGS. 6A-6D). The opposing configurations of the main and arc contacts are more completely illustrated by FIGS. 6A-6D, which are described in greater detail herein below. A controller (not shown) controls actuator system 102, and is located within vacuum enclosure 470 as well. Alternatively, the controller could be located outside of vacuum enclosure 470, which would require a non-moving connection point (not shown) to vacuum enclosure 470. Arc contact pairs 406, 412, 418, 424, 430, 436 are configured in series to form a voltage divider 472, which in effect distributes among the individual arc contacts 402, 404, 408, 410, 414, 416, 420, 422, 426, 428, 432, 424 the total system voltage that is applied across the set of arc contact pairs 406, 412, 418, 424, 430, 436. Main contact pair 446 is in a parallel relationship with the set of arc contact pairs 406, 412, 418, 424, 430, 436. Although FIG. 4 illustrates one main contact pair and one set of arc contact pairs, multiple main contact pairs and multiple sets of arc contact pairs may be provided.

As described in more detail herein below, main contact pair 446 and the set of arc contact pairs 406, 412, 418, 424, 430, 436 shown in FIG. 4 may be arranged along a surface of a cylindrically shaped rotor 604 (shown in FIGS. 6A-6D) such that, when actuator system 102 turns rotor 604, main contact pair 446 and the set of arc contact pairs 406, 412, 418, 424, 430, 436 are either opened or closed based on the direction in which rotor 604 is turned. Main contact pair 446 and the set of arc contact pairs 406, 412, 418, 424, 430, 436 are arranged on the rotor surface such that immediately after the set of arc contact pairs are closed the main contact pair is closed. Similarly, immediately after main contact pair 446 is opened the set of arc contact pairs 406, 412, 418, 424, 430, 436 are opened. By using a single rotor (e.g., rotor 604 shown in FIGS. 6A-6D) to close/open contact pairs, the present disclosure virtually eliminates time delays between individual contact openings. Additionally, because voltage divider 472 allows high system currents to be absorbed, just prior to contact closing the full system voltage appears across the set of arc contacts pairs 406, 412, 418, 424, 430, 436. As the gap between individual contacts breaks down, subsequent arcing can weld individual contacts together. However, because the full system voltage is across the set of arc contacts pairs 406, 412, 418, 424, 430, 436, the degree of melting at the contact points decreases. Voltage divider 472 may be implemented by arranging contact pairs in series, which proportionally increases contact parting speed.

Because rotor 604 separates individual contacts in two directions, the arc created from any metal bridges that may have formed is minimized.

Because vacuum interrupter 100A requires relatively low force to separate contact pairs, actuator system 102 may be implemented as an electromagnet having coils and permanent magnets. A controller (not shown) controls the electromagnet, and is located within vacuum enclosure 470 as well. Alternatively, the controller could be located outside vacuum enclosure 470, which would require a non-moving connection point (not shown) through vacuum enclosure 470. In this configuration, the control wire penetrating vacuum enclosure 470 will still have a much lower leakage rate than prior art bellows designs because it is a nonmoving connection point. When locating the controller within vacuum enclosure 470, the wire to the coil must be insulated (e.g., with a ceramic coating) because conventional wire produces gas, which could damage vacuum enclosure 470. Because the separating force required to separate contact pairs in vacuum interrupter 100A is proportional to the number of contact pairs in voltage divider 472, and because the number of contact pairs in voltage divider 472 may be continuously increased, the force required to separate contact pairs may be driven sufficiently low that an electromagnetic implementation of actuator system 102 may be placed outside vacuum enclosure 470 such that the magnetic field of actuator system 102 penetrates vacuum enclosure 470 to control the opening and closing of contact pairs. Because the air gap between the rotor iron (rotor 604 shown in FIGS. 6A-6D) and the magnet that is moving it is larger, a relatively larger magnet will be required for the external electromagnetic implementation of actuator system 102. In this case, the magnetic field penetrating vacuum enclosure 470 is not a leakage point.

Figure 5A:
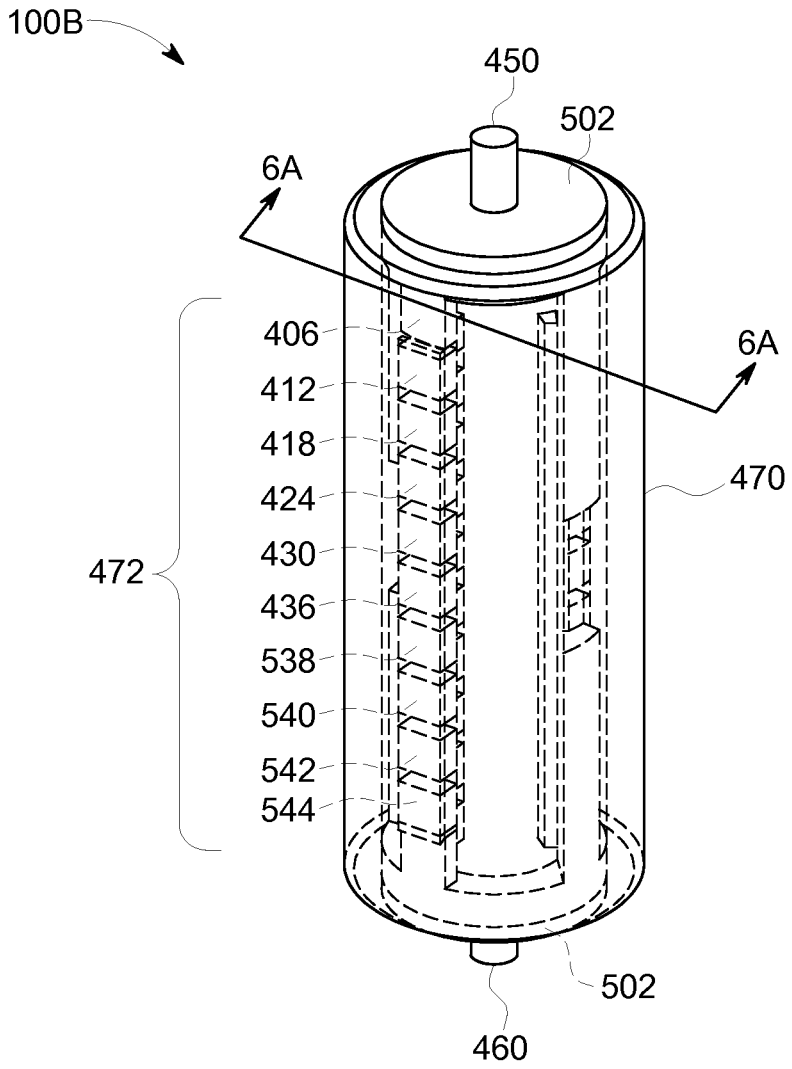
FIG. 5A depicts a three-dimensional view of a rotary vacuum interrupter assembly according to one or more embodiments.
Figure 5B:
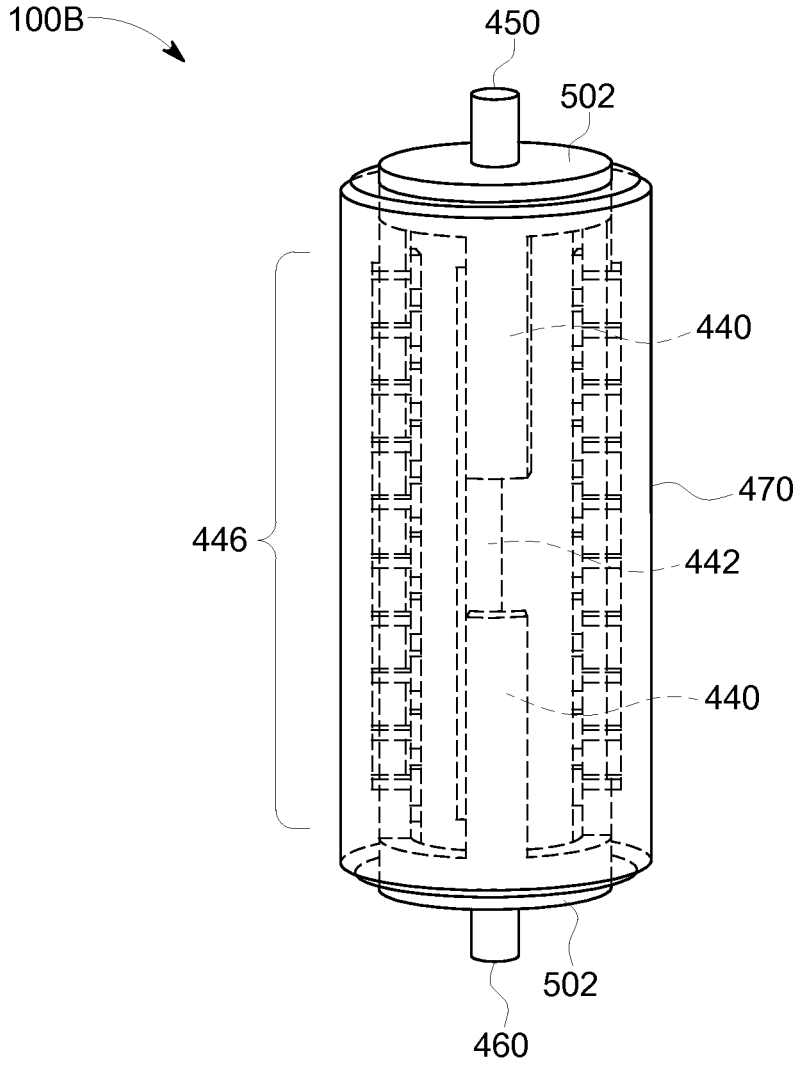
FIG. 5B depicts another three-dimensional view of the rotary vacuum interrupter assembly shown in FIG. 5A according to one or more embodiments.

FIGS. 5A and 5B illustrate a rotary vacuum interrupter 100B, which is a more detailed implementation of vacuum interrupter assembly 100 shown in FIG. 3 and rotary vacuum interrupter assembly 100A shown in FIG. 4. FIGS. 5A and 5B are substantially identical except that FIG. 5A provides a better illustration of voltage divider 472, and FIG. 5B provides a better illustration of main contact pair 446 formed from individual main contacts 440, 442. Rotary vacuum interrupter assembly 100B includes vacuum enclosure 470, end terminals 450, 460, end caps 502, main contact pair 446 formed from individual main contacts 440, 442, and a set of arc contact pairs 406, 412, 418, 424, 430, 436, 538, 540, 542, 544 each formed from individual arc contacts (e.g., 402, 404, 408, 410, 414, 416, 420, 422, 426, 428, 432, 424 shown in FIG. 4), configured and arranged as shown. Arc contacts 406, 412, 418, 424, 430, 436, 538, 540, 542, 544 are configured to form a voltage divider 472 (shown in FIG. 7B), which in effect distributes among the individual arc contacts (e.g., 402, 404, 408, 410, 414, 416, 420, 422, 426, 428, 432, 424 shown in FIG. 4) the total system voltage that is applied across the set of arc contact pairs 406, 412, 418, 424, 430, 436, 538, 540, 542, 544. Main contact pair 446, which is formed from individual main contacts 440, 442, is in a parallel relationship with the set of arc contact pairs 406, 412, 418, 424, 430, 436, 538, 540, 542, 544. Main contact pair 446 and the set of arc contact pairs 406, 412, 418, 424, 430, 436, 538, 540, 542, 544 are arranged along a surface of rotor 604 (shown in FIGS. 6A-6B) such that, when actuator system 102 (shown in FIG. 4) turns rotor 604, main contact pair 446 and the set of arc contact pairs 406, 412, 418, 424, 430, 436, 538, 540, 542, 544 are either opened or closed based on the direction in which rotor 604 is turned. Main contact pair 446 and the set of arc contact pairs 406, 412, 418, 424, 430, 436, 538, 540, 542, 544 are arranged on the rotor surface such that immediately after the set of arc contact pairs are closed the main contact pair is closed. Similarly, immediately after main contact pair 446 is opened the set of arc contact pairs 406, 412, 418, 424, 430, 436, 538, 540, 542, 544 are opened.

Figure 6A:
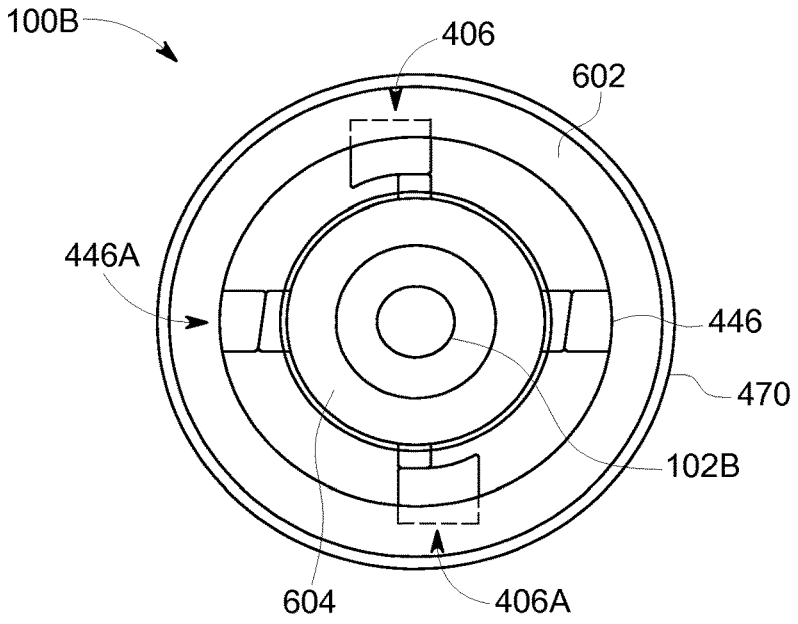
FIG. 6A depicts a sectional view of the rotary vacuum interrupter assembly shown in FIGS. 5A and 5B taken along line 6A-6A.
Figure 6B:
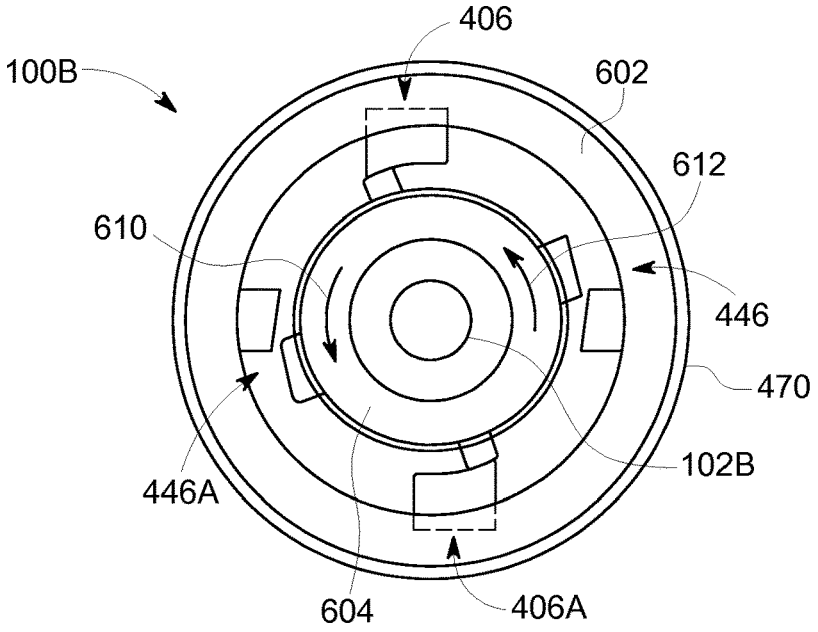
FIG. 6B depicts another sectional view of the rotary vacuum interrupter assembly shown in FIGS. 5A and 5B taken along line 6A-6A.
Figure 6C:
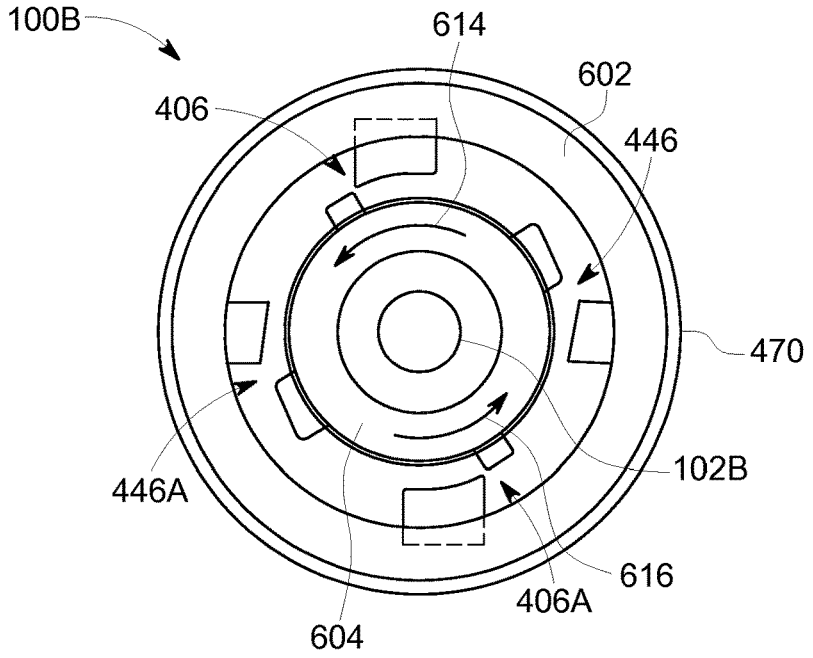
FIG. 6C depicts another sectional view of the rotary vacuum interrupter assembly shown in FIGS. 5A and 5B taken along line 6A-6A.
Figure 6D:
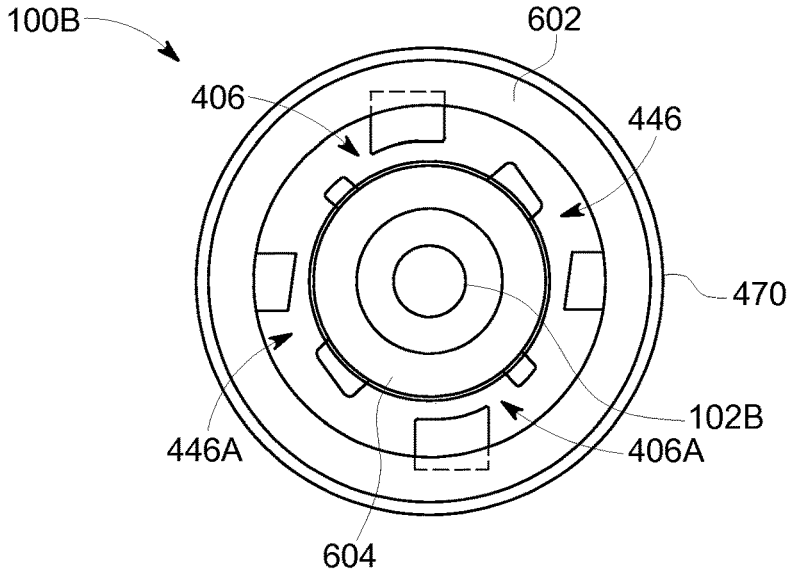
FIG. 6D depicts another sectional view of the rotary vacuum interrupter assembly shown in FIGS. 5A and 5B taken along line 6A-6A.

FIGS. 6A-6D depict a sectional view taken along line 6A-6A of rotary vacuum interrupter 100B shown in FIG. 5A. Accordingly, FIGS. 6A-6D depict vacuum interrupter 100B in a plane that cuts through rotor 604 and provides a more complete illustration of the opposing contact configuration between main contact pair 446 and main contact pair 446A, as well as between arc contact pair 406 and arc contact pair 406A. FIGS. 6A-6D show rotary vacuum interrupter 100B during various stages of interrupting a path for current flow. As shown in FIGS. 6A-6D, rotary vacuum interrupter 100B includes vacuum enclosure 470, an actuator system 102B, a stator 602, a rotor 604, main contact pairs 446, 446A, and arc contact pairs 406, 406A, configured and arranged as shown. Rotor 604 and stator 602 move relative to each other to open and close contact pairs connected between rotor 604 and stator 602. For the embodiment shown in FIGS. 6A-6D, stator 602 is stationary, and rotor 604 is rotated by actuator system 102B. In alternative embodiments, stator 602 may be the rotating element and element 604 may be the fixed element. In further alternative embodiments, both elements 602, 604 are moveable. In FIG. 6A main contact pairs 446, 446A and arc contact pairs 406, 406A are closed. Although only arc contact pairs 406, 406A are shown, it is understand that the various movements of arc contact pairs 406, 406A illustrated in FIGS. 6A-6D occur with all arc contact pairs of rotary vacuum interrupter 100B. Current through vacuum interrupter 100B will flow through main contact pairs 446, 446A because there are only two sets of main contact pairs, and main contact pairs 446, 446A provide the lowest resistance paths for current. In FIG. 6B, actuator system 102B has initiated a counter clockwise rotational movement of rotor 604 such that main contact pair 446 has opened in a first direction 610 and main contact pair 446A has opened in a second direction 612. The counter clockwise rotational movement of rotor 604 moves arc contact pairs 406, 406A, but the distance of the rotational movement is insufficient to open them. In FIG. 6C actuator system 102B continues to effect a counter clockwise rotational movement of rotor 604 such that arc contact pair 446 begins to separate in a third direction 614, and arc contact pair 446A begins to separate in a fourth direction 616. In FIG. 6D actuator system 102B continues to effect a counter clockwise rotational movement of rotor 604 such that main contact pairs 446, 446A and arc contact pairs 406, 406A are fully opened and current has been interrupted.

Figure 7A:
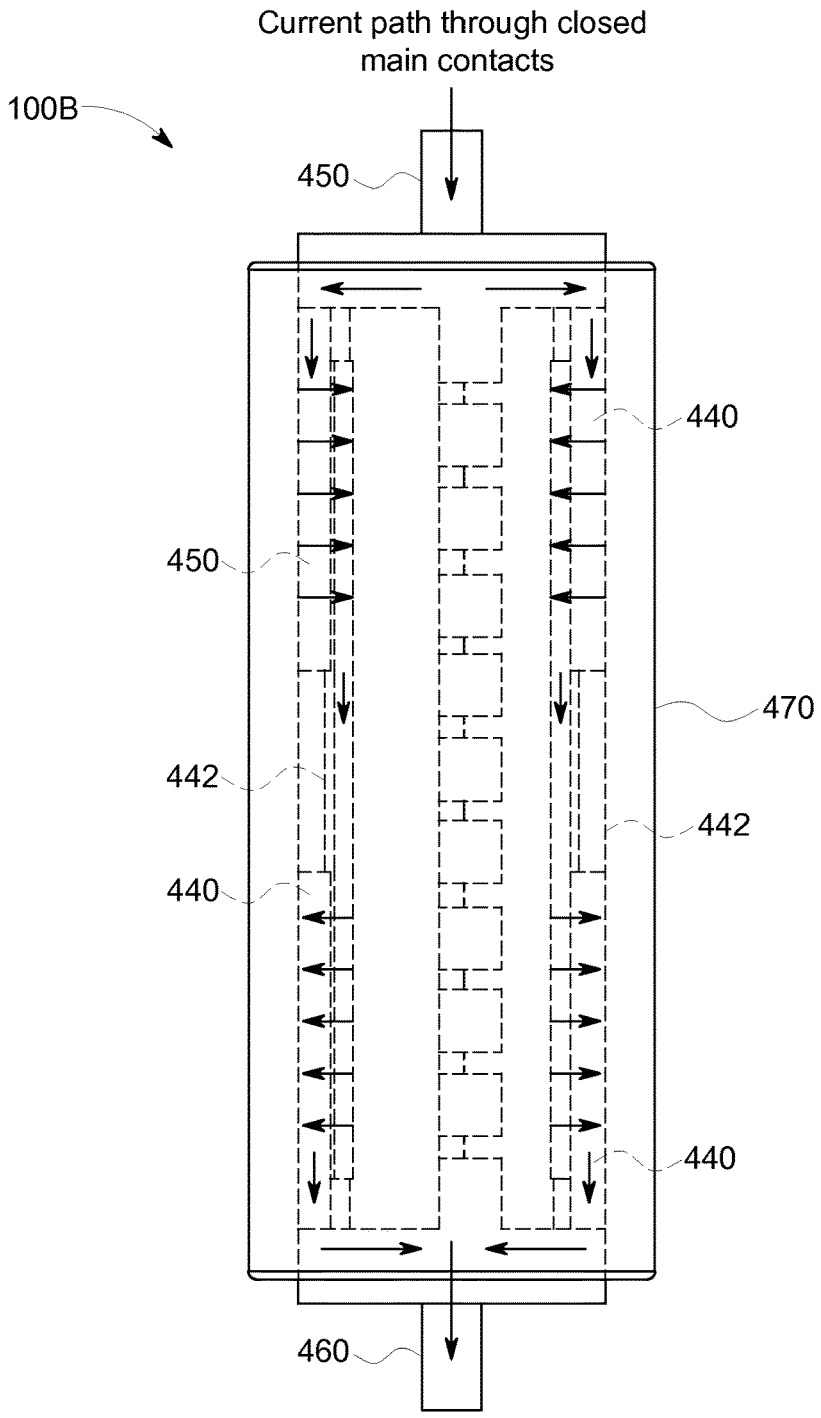
FIG. 7A depicts a two-dimensional view of the rotary vacuum interrupter assembly shown in FIGS. 5A and 5B according to one or more embodiments.
Figure 7B:
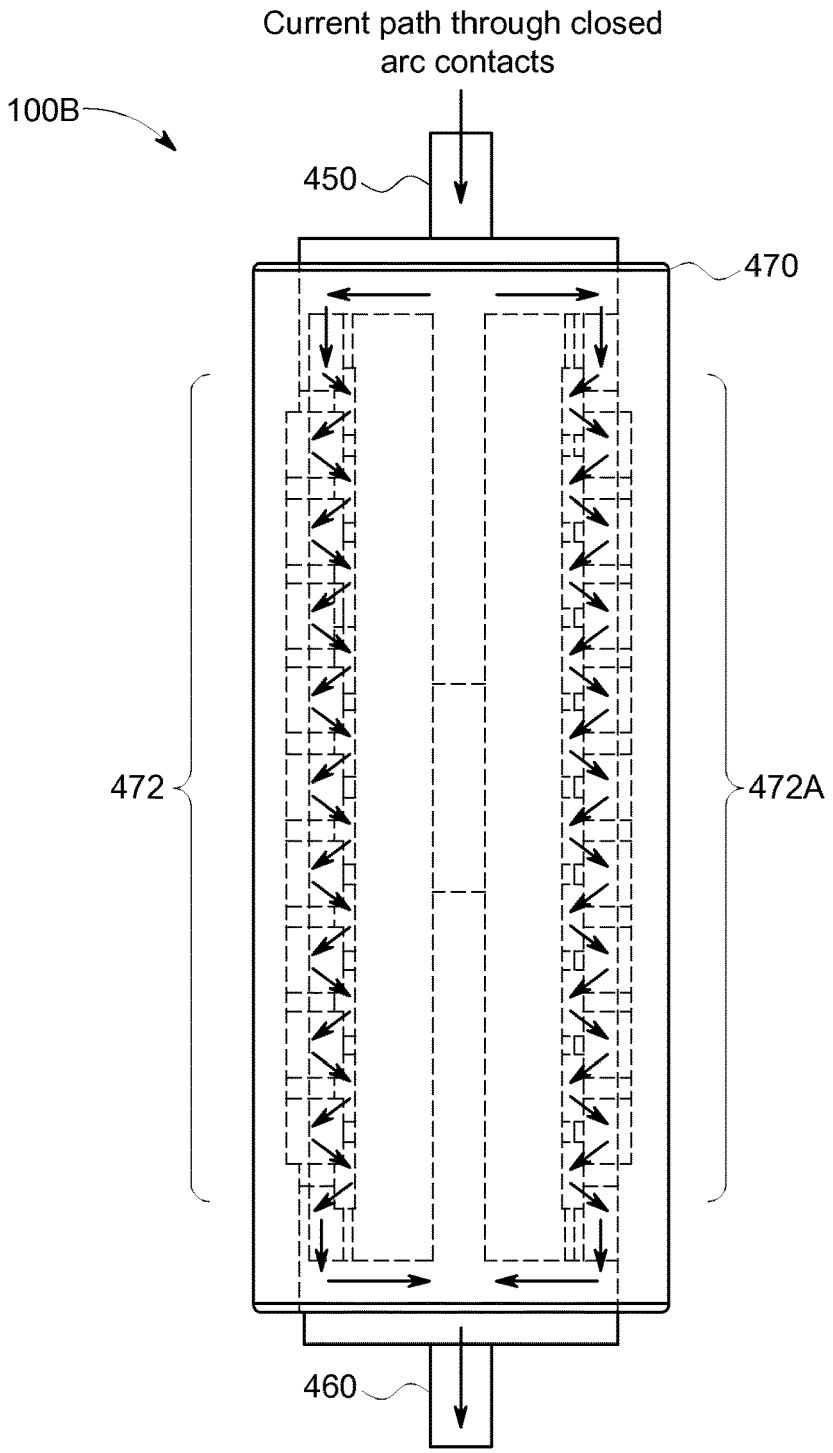
FIG. 7B depicts another two-dimensional view of the rotary vacuum interrupter assembly shown in FIGS. 5A and 5B according to one or more embodiments.

FIGS. 7A and 7B depict two-dimensional views of rotary vacuum interrupter 100B showing current paths through rotary vacuum interrupter 100B. More specifically, FIG. 7A illustrates the current paths through main contact pairs when they are closed, and FIG. 7B illustrates the current paths through the arc contact pairs that form voltage dividers 472, 472A when the arc contact pairs are closed.

Figure 8:
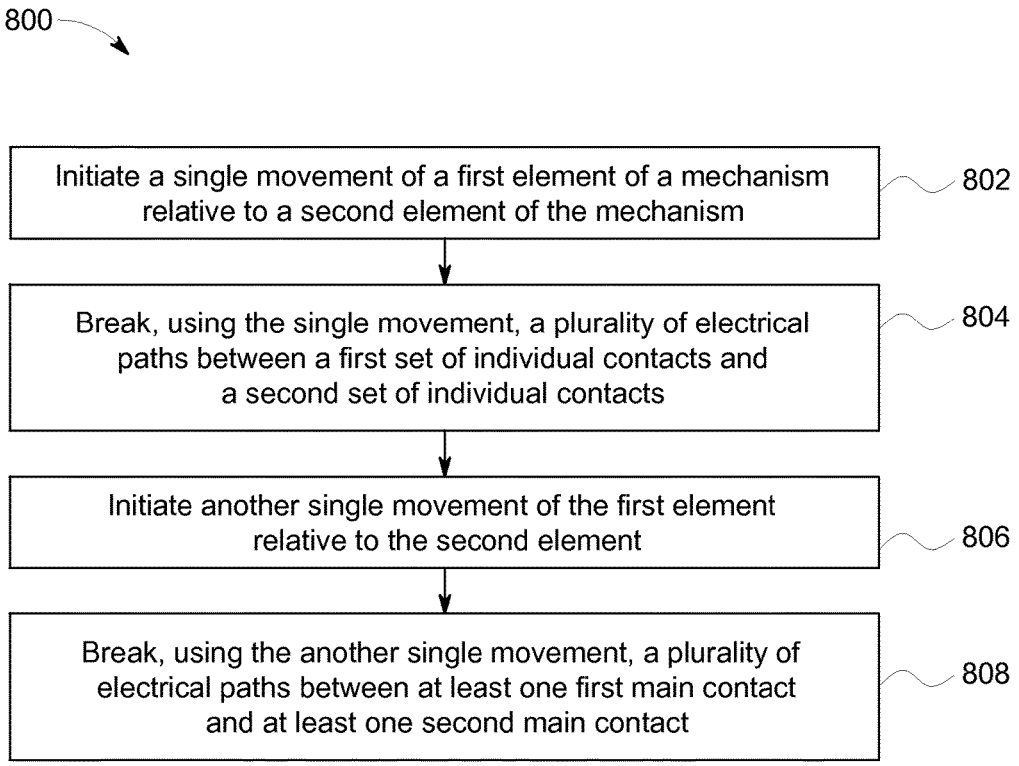
FIG. 8 is a flow diagram illustrating a method of operating an over-current protection assembly according to one or more embodiments.

FIG. 8 depicts a flow diagram illustrating a methodology 800 for operating an over-current protection assembly according to one or more embodiments. The order of operations shown in FIG. 8 is for convenience, and it is to be understood that the illustrated operations may be performed in another order without departing from the scope of the present disclosure. In addition, some individual operations shown in FIG. 8 may be omitted, or some operations not shown in FIG. 8 may be added, without departing from the scope of the present disclosure. Block 802 of methodology 800 initiates a single movement of a first operating element of a mechanism relative to a second operating element of the mechanism. Block 804 breaks, using the single movement, a plurality of electrical paths between a first set of individual contacts and a second set of individual contacts. Block 806 initiates another single movement of the first operating element relative to the second operating element. Block 808 breaks, using the "another" single movement, a plurality of electrical paths between at least one first main contact and at least one second main contact. In one or more embodiments, individual contacts of the first and second sets of individual contacts are arranged in a voltage divider configuration. In effect, the voltage divider formed by the individual contacts of the first and second sets of individual contacts divides among the individual contacts the total voltage that is present across the first and second set of individual contacts. For example, if the total voltage across the interrupter is 15000 volts, each of the 20 series arranged contact surfaces has 750 volts.

Figure 9:
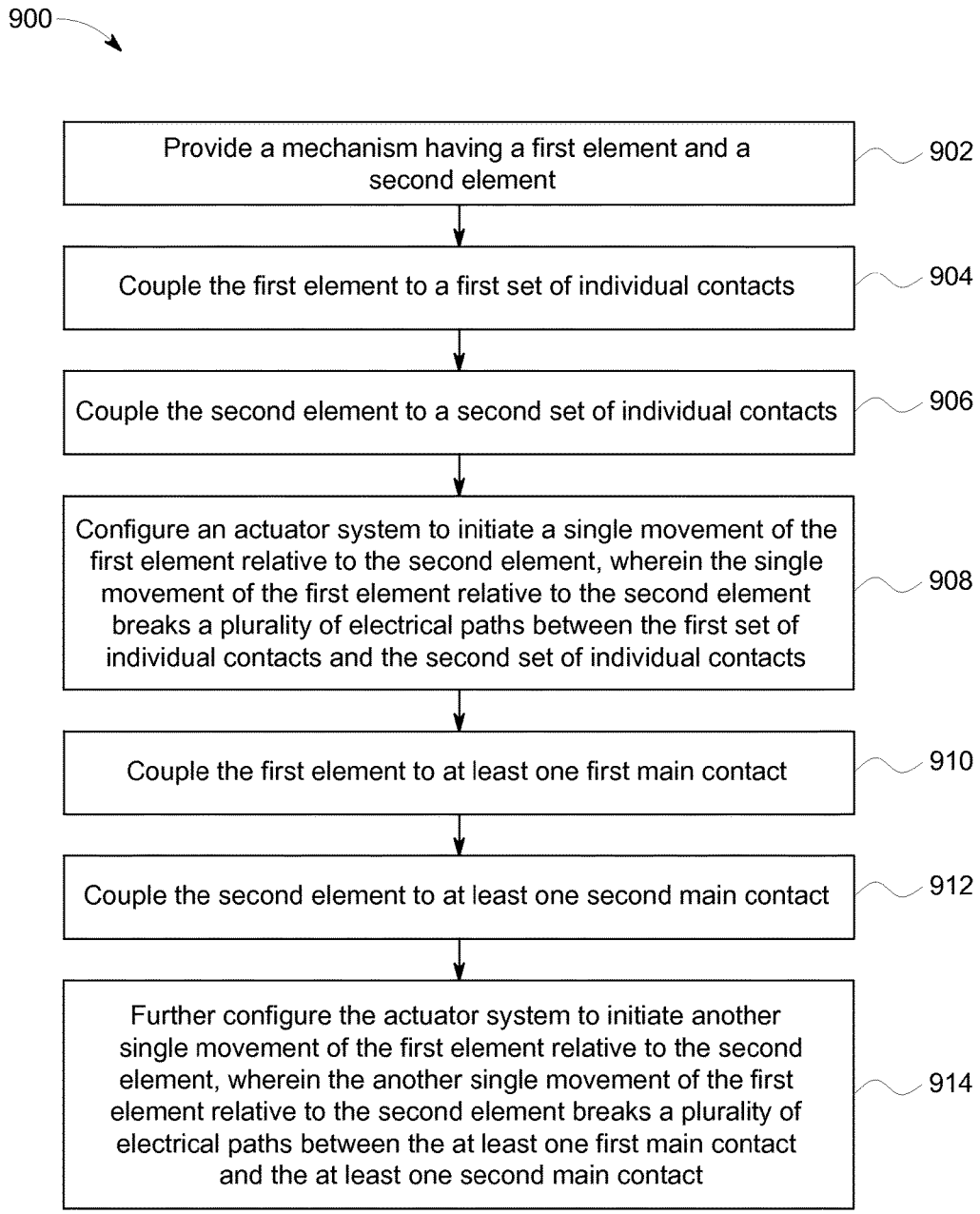
FIG. 9 is a flow diagram illustrating a method of making an over-current protection assembly according to one or more embodiments.

FIG. 9 depicts a flow diagram illustrating a methodology 900 for making an over-current protection assembly according to one or more embodiments. The order of operations shown in FIG. 9 is for convenience, and it is to be understood that the operations may be performed in another order without departing from the scope of the present disclosure. In addition, some individual operations shown in FIG. 9 may be omitted, or some operations not shown in FIG. 9 may be added, without departing from the scope of the present disclosure. Block 902 of methodology 900 provides a mechanism having a first operating element and a second operating element. Block 904 couples the first operating element to a first set of individual contacts. In one or more embodiments, individual contacts of the first set of individual contacts are arranged in a voltage divider configuration. Block 906 couples the second operating element to a second set of individual contacts. In one or more embodiments, individual contacts of the second set of individual contacts are arranged in a voltage divider configuration. In effect, the voltage divider formed by the individual contacts of the first and second sets of individual contacts divides among the individual contacts the total voltage that is present across the first and second set of individual contacts. Block 908 configures an actuator system to initiate a single movement of the first operating element relative to the second operating element, wherein the single movement of the first operating element relative to the second operating element breaks a plurality of electrical paths between the first set of individual contacts and the second set of individual contacts.

Continuing with methodology 900, block 910 couples the first operating element to at least one first main contact. Block 912 couples the second operating element to at least one second main contact. Block 914 further configures the actuator system to initiate another single movement of the first operating element relative to the second operating element, wherein the another single movement of the first operating element relative to the second operating element breaks at least one electrical path between the at least one first main contact and the at least one second main contact.

Figure 10:
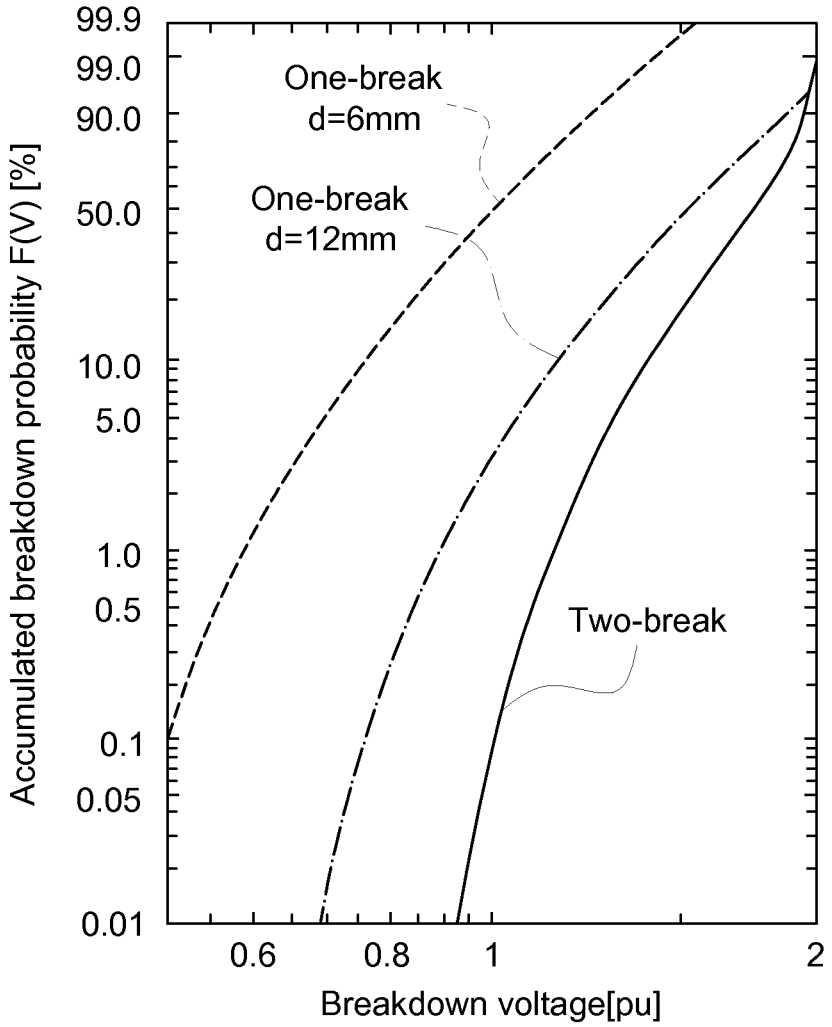
FIG. 10 is a diagram illustrating operational advantages of one or more embodiments.

FIG. 10 is a diagram illustrating operational advantages of one or more embodiments. More specifically, FIG. 10 illustrates the improved breakdown probability distribution of a two-break vacuum circuit breaker (VCB) over one-break VCBs. The embodiment efficiently places two or more breaks within one interrupter assembly. According to one or more embodiments of the present disclosure, by placing contact pairs along a rotating shaft, the need for complex linkages to open/close contacts is eliminated. Additionally, by placing many contact pairs (e.g., arc contact pairs) along the rotating shaft in a voltage dividing series arrangement, along with other contact pairs (e.g., main contact pairs) optionally placed in a parallel configuration in relation to the series contact pairs, voltages and/or current loads significantly higher than the system voltage and/or current load may be accommodated. The multi-contact configuration of the present disclosure requires relatively small separation distances to interrupt the circuit, and requires relatively low force to separate individual contact.

Figure 11:
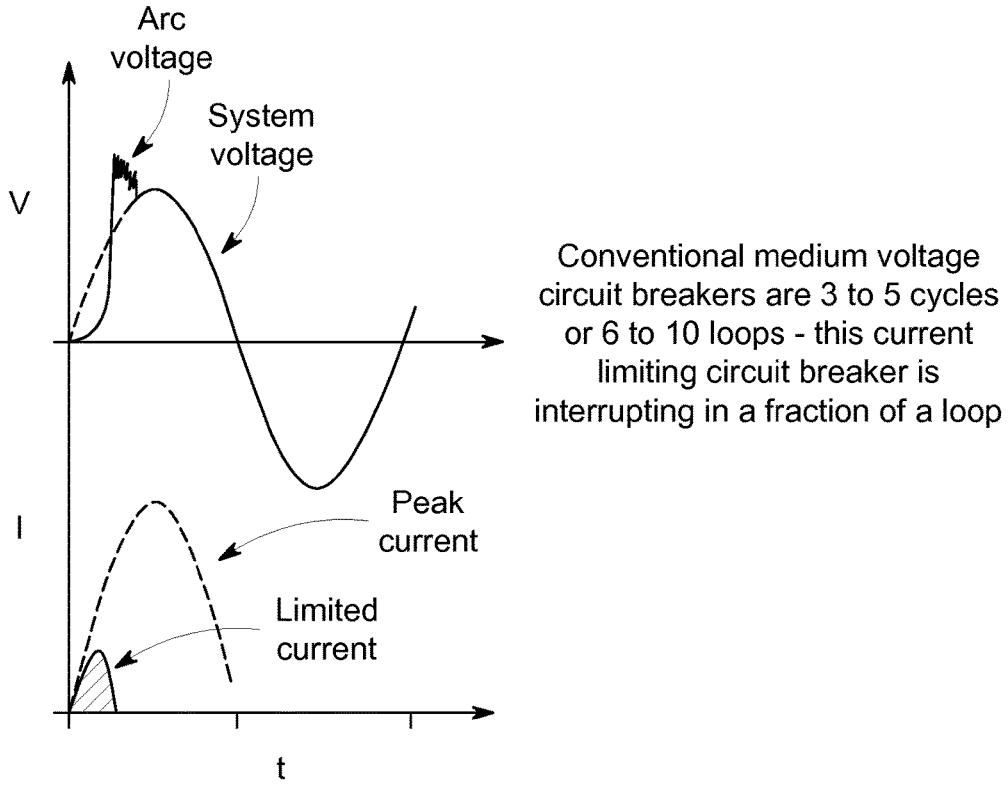
FIG. 11 is a diagram further illustrating operational advantages of one or more embodiments.

FIG. 11 is a diagram further illustrating operational advantages of one or more embodiments. More specifically, FIG. 11 illustrates the current limiting benefits that derive from implementing a circuit breaker that can produce an arc voltage that exceeds the system voltage. The operator can be designed with all three poles operating off of one magnetic controller or three separate magnetic controllers can be design to open each pole at either a current or voltage zero. With the contacts opening at voltage zero the current will instantaneously interrupt. As shown by the top diagram, when the arc voltage exceeds the system voltage, the current is limited and forced to zero. As shown by the bottom diagram, because the high arc voltage has limited the current, instead of having to withstand the full short circuit current for several cycles, the circuit breaker interruption can occur immediately after arc voltage exceeds the system voltage. As noted previously herein, according to one or more embodiments of the present disclosure, by placing many contact pairs (e.g., arc contact pairs) along the rotating shaft in a voltage dividing series arrangement, along with other contact pairs (e.g., main contact pairs) optionally placed in a parallel configuration in relation to the series contact pairs, the arc voltages can exceed the system voltage thereby causing the current to be collapsed rapidly. The number of contacts required would be a function of the contact metals, contact geometry and gas used within the interrupter.

Figure 12:
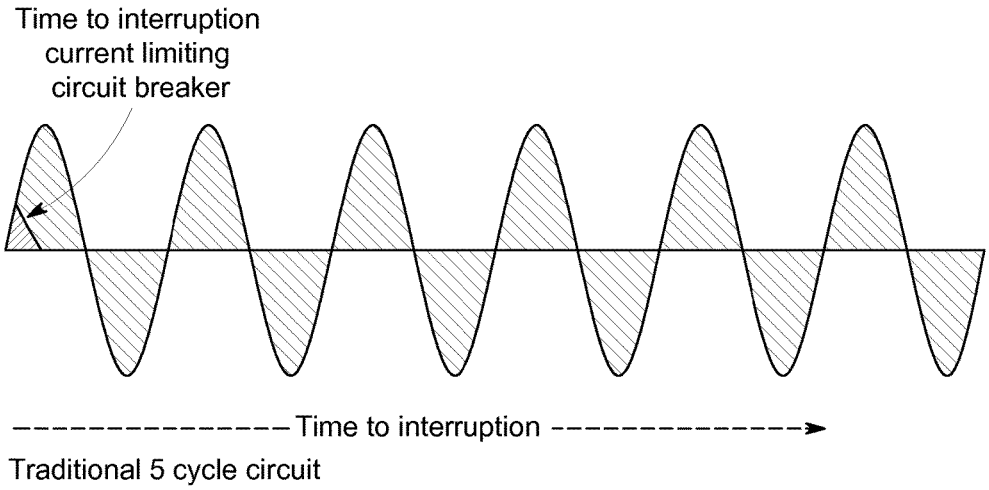
FIG. 12 is a diagram further illustrating operational advantages of one or more embodiments.

FIG. 12 is a diagram further illustrating operational advantages of one or more embodiments. More specifically, FIG. 12 further illustrates the current limiting concepts shown in FIG. 11. The top diagram of FIG. 12 illustrates the number of current cycles (5) that the arcing contacts must be absorbed by a 25 kilo-ampere (kA) circuit breaker before current interruption occurs. The bottom diagram of FIG. 12 illustrates the number of current cycles that must be absorbed by a current limited circuit breaker before current interruption occurs. As shown in the bottom diagram, the current limited breaker absorbs only a fraction of one loop of one cycle of alternating current. For ease of comparison, the number of current cycles (5) that must be absorbed by a 25 kA circuit breaker before current interruption occurs is shown by the dotted line curve in the bottom diagram. According to one or more embodiments of the present disclosure, by placing contact pairs along a rotating shaft, the need for complex linkages to open/close contact pairs is eliminated. This allows many contacts (e.g., arc contact pairs) to be placed in a voltage dividing series arrangement, along with other contact pairs (e.g., main contact pairs) without requiring grading capacitors. Contacts can be optionally placed in a parallel configuration to the series contact pairs, thereby accommodating higher current loads. With enough contacts placed in series the circuit breaker can be designed to current limit. Accordingly, as illustrated by FIG. 12, the present disclosure efficiently and effectively takes advantage of the operational efficiencies that result from providing a current limited over-current protection assembly.

Thus, it can be seen from the foregoing description and illustrations that one or more embodiments of the present disclosure provide technical features and benefits. By providing a plurality of contact pairs (e.g., arc contact pairs) in a voltage dividing configuration on a rotor, and by actuating movement of the individual contacts into and out of contact with each other through a rotation of the rotor relative to a stator, the systems and methodologies of the present disclosure eliminate the need for bellows and seals, thereby eliminating the possibility of leakage from the interrupter chamber through the bellows and seals. Welding is minimized because voltage is divided across several individual arc contact pairs in series with one another. Interrupting capabilities are enhanced because the contacts pairs arranged in series divide the transient recovery voltages that can reignite the current across the contacts after current zero. Arc contact pairs arranged in series and with optimized materials allow a higher total arc voltage across all the contacts, thereby minimizing current chopping. The tolerance of one or more embodiments for relatively high contact temperatures for the arcing contacts allows the main contact pair to be implemented with high conductivity materials. High conductivity materials allow the design to have lower temperatures or smaller conductors for the main contacts. Because the present disclosure separates contacts in different directions (e.g., 610, 612, 614, 616 shown in FIGS. 6B and 6C), the tendency to form or make metal bridges or welds is minimized. Thus, the need for welding inhibiting materials to improve re-strike behavior is eliminated, thereby eliminating the design pits, bridges and rough surfaces that can be created by welding and subsequent breaking of those welds. The operator energy can be reduced as welding forces will be limited.

The flowchart and block diagrams in the figures illustrate the functionality and operation of possible implementations of systems and methods according to various embodiments of the present disclosure. In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate with the spirit and scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

The invention claimed is:

1. An over-current protection assembly comprising:

a mechanism having a first operating element and a second operating element;

the first operating element coupled to a first set and a third set of individual contacts;

the second operating element coupled to a second set and a fourth set of individual contacts; and a first plurality of electrical paths, each electrical path of the first plurality of electrical paths defined between one individual contact of the first set of individual contacts and one individual contact of the second set of individual contacts;

a second plurality of electrical paths between the third set of individual contacts and the fourth set of individual contacts;

wherein the first operating element is selectively rotatable relative to the second operating element to establish and break the first plurality of electrical paths;

the third set of individual contacts selectively moveable relative to the fourth set of individual contacts in order to establish and break the second plurality of electrical paths;

wherein a rotational movement of the first operating element relative to the second operating element breaks the first plurality of electrical paths between the first set of individual contacts and the second set of individual contacts in a first direction; and wherein a rotational movement of the first operating element relative to the second operating element breaks the second plurality of electrical paths between the third set of individual contacts and the fourth set of individual contacts in a second direction different from the first direction.

2. The assembly of claim 1, wherein:

the first set of individual contacts and the second set of individual contacts are configured to comprise a voltage divider.

3. The assembly of claim 2, wherein:

the voltage divider is configured to divide among the first set of individual contacts and the second set of individual contacts a total voltage that is present across the first set of individual contacts and the second set of individual contacts.

4. The assembly of claim 1 further comprising:

the first operating element coupled to at least one fifth individual contact;

the second operating element coupled to at least one sixth individual contact;

at least one third electrical path between the at least one fifth individual contact and the at least one sixth individual contact; and the at least one fifth individual contact selectively moveable relative to the at least one sixth individual contacts in order to establish and break the at least one third electrical path;

wherein another movement of the first operating element relative to the second operating element breaks the at least one third electrical path between the at least one fifth individual contact and the at least one sixth individual contact.

5. The assembly of claim 4, wherein the mechanism further comprises an actuation system coupled to at least the first operating element for effecting the rotational movement and the another movement.

6. The assembly of claim 5 wherein the actuation system comprises an electromagnet having coils and permanent magnets.

7. The assembly of claim 4, wherein:

the at least one fifth individual contact comprises a main contact; and the at least one sixth individual contact comprises another main individual contact.

8. The assembly of claim 7, wherein the rotational movement is subsequent to the another movement.

9. The assembly of claim 1, wherein the first set of individual contacts comprise arc contacts.

10. The assembly of claim 1, wherein:

at least one of the first operating element and the second operating element comprises an insulator.

11. The assembly of claim 1, wherein:

the first operating element comprises a first cylinder; and the coupling of the first operating element to the first set of individual contacts comprises an arrangement of the first set of individual contacts along a surface of the first cylinder.

12. The assembly of claim 11, wherein:

the second operating element comprises a second cylinder; and the coupling of the second operating element to the second set of individual contacts comprises an arrangement of the second set of individual contacts along a surface of the second cylinder.

13. The assembly of claim 1 further comprising:

a chamber containing:

the mechanism;

the first set of individual contacts;

the second set of individual contacts; and an interrupting medium.

14. The assembly of claim 1, wherein the rotational movement comprises a single movement.

15. The assembly of claim 1 wherein the selective movement of the first operating element causes each of the first set of individual contacts to one of open and close with the corresponding contact of the second set of individual contacts with no time delay between the corresponding closing and opening of any additional contact pairs.

16. The assembly of claim 1 wherein the first plurality of electrical paths are arranged electrically in series with one another.

17. A method of operating an over-current protection assembly, the method comprising:

initiating a rotational movement of a first operating element of a mechanism relative to a second operating element of the mechanism;

wherein the first operating element is coupled to a first set of individual contacts and further coupled to at least one first main contact;

wherein the second operating element is coupled to a second set of individual contacts and further coupled to at least one second main contact; wherein a first plurality of electrical paths exist such that each electrical path of the first plurality of electrical paths is defined between one individual contact of the first set of individual contacts and one individual contact of the second set of individual contacts; and breaking in a first direction, by the rotational movement, the first plurality of electrical paths between the first set of individual contacts and the second set of individual contacts;

initiating another movement of the first operating element relative to the second operating element; and breaking by the another movement, contact between the at least one first main contact and the at least one second main contact, in a second direction different from the first direction.

18. The method of claim 17, wherein the first set of individual contacts and the second set of individual contacts comprise a voltage divider, the method further comprising:

dividing, by the voltage divider, among the individual contacts a total voltage that is present across the first and second sets of individual contacts.

19. The method of claim 17, wherein the rotational movement comprises a single movement.

20. A method of making an over-current protection assembly, the method comprising:

providing a mechanism having a first operating element and a second operating element;

coupling the first operating element to a first set of individual contacts;

coupling the second operating element to a second set of individual contacts, wherein a first plurality of electrical paths, wherein each electrical path of the first plurality of electrical paths is defined between one individual contact of the first set of individual contacts and one individual contact of the second set of individual contacts; and configuring an actuator system to initiate a rotational movement of the first operating element relative to the second operating element;

wherein the rotational movement of the first operating element relative to the second operating element breaks, in a first direction, a first plurality of electrical paths between the first set of individual contacts and the second set of individual contacts;

coupling the first operating element to at least one first main contact;

coupling the second operating element to at least one second main contact; and further configuring the actuator system to initiate another movement of the first operating element relative to the second operating element;

wherein the another movement of the first operating element relative to the second operating element breaks, in a second direction different from the first direction, at least one electrical path between the at least one first main contact and the at least one second main contact.

21. The method of claim 20 further comprising:

configuring the first set of individual contacts and the second set of individual contacts as a voltage divider;

wherein the voltage divider divides among the individual contacts a total voltage that is present across the first and second sets of individual contacts.

22. The method of claim 20, wherein the coupling of the first operating element to the first set of individual contacts comprises arranging the individual contacts of the first set in series along a surface of the first operating element.

23. The method of claim 20, wherein the rotational movement comprises a single movement.

* * * * *